US006926260B1

(12) United States Patent
De Groot et al.

(10) Patent No.: US 6,926,260 B1
(45) Date of Patent: Aug. 9, 2005

(54) COMPENSATION AND HOISTING APPARATUS

(75) Inventors: Anne Klaas De Groot, Sugar Land, TX (US); Joop Roodenburg, Delft (NL); Robert Frodo Van Kuilenburg, Dordrech (NL)

(73) Assignee: Itrec B.V., (NL)

( * ) Notice: Subject to any disclaimer, the term of this patent is extended or adjusted under 35 U.S.C. 154(b) by 104 days.

(21) Appl. No.: 10/429,820

(22) Filed: May 5, 2003

Related U.S. Application Data

(63) Continuation-in-part of application No. 09/807,078, filed on Jul. 2, 2001, now Pat. No. 6,595,494.

(51) Int. Cl.[7] ..... B63B 23/02
(52) U.S. Cl. ..... 254/277; 254/285; 254/900
(58) Field of Search ..... 254/277, 377, 254/290, 291, 285, 387, 900

(56) References Cited

U.S. PATENT DOCUMENTS

| | | | | |
|---|---|---|---|---|
| 3,658,298 A | 4/1972 | Moore | ..... | 254/190 |
| 3,714,995 A | 2/1973 | Hanes | ..... | 175/5 |
| 3,791,628 A | 2/1974 | Burns | ..... | 254/172 |
| 3,804,183 A | 4/1974 | Duncan | ..... | 175/5 |
| 3,917,230 A | 11/1975 | Barron | ..... | 254/173 |
| 4,423,994 A | 1/1984 | Schefers | ..... | 414/22 |
| 4,620,692 A | 11/1986 | Foreman | ..... | 254/277 |
| 4,688,764 A | 8/1987 | Nayler | ..... | 254/277 |
| 4,867,418 A | 9/1989 | Daniels | ..... | 254/277 |
| 5,894,895 A | 4/1999 | Welsh | ..... | 175/5 |

FOREIGN PATENT DOCUMENTS

| | | | |
|---|---|---|---|
| GB | 2171974 | 3/1985 | ..... B66C 13/04 |

*Primary Examiner*—Emmanuel Marcelo
(74) *Attorney, Agent, or Firm*—Buskop Law Group, P.C.; Wendy Buskop

(57) ABSTRACT

The invention is a hoisting device for a vessel a base structure provided with fixed cable blocks with pulleys; a trolley connected to a cable pulley block and a mechanism for gripping a load; a compensator a hoisting mechanism with a hoisting cable and a winch, wherein the hoisting cable is guided over the cable pulleys connected to the base structure and is adapted to move the trolley relative to the base structure with the aid of the winch; a secondary compensator with fixed cable blocks and pulleys connected to the base; a cable pulley set connected to the compensator end; a connection cable connected to a stationary section and a movable cable block with pulleys; a hoist connected to the vessel; a connecting cable guided over pulleys; and movable cable block and is adapted to move the compensator second end with the aid of the secondary hoisting mechanism.

15 Claims, 8 Drawing Sheets

COMPENSATION AND HOISTING APPARATUS

The present continuation in part application claims priority to patent application Ser. No. 09/807,078 now U.S. Pat. No. 6,595,494 filed in the U.S. Patent and Trademark Office on Jul. 2, 2001.

FIELD OF THE INVENTION

The present invention relates to a hoist system connected to a floating vessel that minimizes the energy consumption and operating cost of lifting operations.

BACKGROUND OF THE INVENTION

The present invention relates to apparatus for controlling the stress in a running string, and more particularly to apparatus used on or in connection with a floating vessel for maintaining the strain in a running string, such as a pipe string, substantially constant while being used in the performance of diverse functions in a sub-aqueous well bore, such as drilling and completion operations therein, despite vertical movement of the vessel while such operations are being performed.

In the normal operation of drilling a well bore on land, or from a drilling platform supported in a fixed position from the ocean floor, the weight on the drilling bit is equal to the total weight of the drilling string less the weight of the drill pipe carried by the drawworks. Usually, the weight imposed on the bit is equal to the weight of the drill collar sections connected to the lower end of the drill pipe. In drilling a sub-aqueous well bore from a floating vessel, the heaving of the vessel under tide, wind and wave conditions introduces problems of maintaining the drilling weight on the bit at the desired value. It is desirable that the drill string be maintained at uniform tension and that variations in tension be minimized in order to carry on normal drilling and well completion operations, prevent undue stressing of the drill string, uneven drill bit pressure, and excessive wear on the drilling equipment, as well as to maintain a fixed in-hole drill string elevation for landing casing, tubing, setting packers, cementing, reaming and other operations requiring close elevation control.

In addition, the vertical movement of the drill string causes the shifting of stresses in the drill collars where the point of neutral stress (change between compression and tension) may cross a drill collar or pipe joint causing undue stressing of such joint and possible failure. Such constantly changing stress at drill collar sections may cause deformation of the drill collars and produce unnecessary cutting of sides of a hole or hole deviation by the resultant dissipation of drilling energy into a lateral direction instead of a vertical direction.

Efforts to cope with the heave problems have produced two principal forms of compensating apparatus. One form is carried by the traveling block and comprises a power cylinder arrangement with pressure ballast to provide force to equal hook load. The traveling compensator system works but adds to the ton miles of work done by the draw works. A second compensator concept comprises a ballasted support for the crown block which moves it vertically relative to the derrick and allows it to maintain a practically uniform distance between crown block and sea bed. The draw works is mounted on and moving with the heaving vessel and complicates the situation. The greatest drawback, however, is the added structural mass high in the derrick. More is required of a vessel for it to remain within stability limits with the extra weight aloft.

The technical burden of the currently available compensator systems is constant whether they are active or passive, in terms of the dead weight present far above the vessel metacentric height.

Also one of the main disadvantages of compensating devices where the drill string is supported hydraulically is the vessel motion dependent behavior of the hydraulic spring that is supporting the load. If the vessel moves the compensating force changes considerably. Motion compensating devices have been proposed for overcoming the aforenoted difficulty. Such types of apparatus, and similar apparatus, are illustrated in U.S. Pat. Nos. 3,714,995, 3,791,628, 5,894,895, 4,423,994 and 4,620,692. In general, the devices illustrated therein rely upon additional controlling devices or complex mechanical solutions to de-couple the motions of the vessel and the resulting compensation force.

With hydraulically supported compensation devices the compensation cylinder acts as a spring with a very low stiffness. Since the "spring" does not have an indefinitely low stiffness a certain variation in the line tension is always necessary to retract or extend the compensation cylinder. This makes the system unsuitable to compensate for loads that are hanging free. This is a disadvantage. The so called "active heave" compensation systems are able to work with loads that are hanging free. Current systems that are used have several disadvantages. The systems are often heavy since they need to support the full load and consume a lot of energy when compensating. Often "active heave compensation" is done using the single drawworks winch, with no redundancy in case this winch breaks down.

It is therefore an object of the invention to provide a compensation system in which the compensation force is not influenced by the motions of the vessel and that is suitable to compensate for the motions of the vessel even when the load is hanging free without excessive power consumption during use and with build in redundancy.

It is furthermore an object of this invention to provide a simple compensation system that does not need to be installed at the top of the derrick.

Also it is an object of this invention to provide a compensation system that is capable of holding a constant tension on the drill bit regardless of the motions of the vessel.

In the devices according to the prior art it is customary for a hoisting cable to be attached to a fixed point at one end. The other end of the hoisting cable is then wound around a winch. If this winch breaks down, it is no longer possible to work with the device. The mentioned winch has also to be of relatively large and costly design to meet with all the required demands. Repeated bending at the same places is a major factor of wear of the cable during normal hoisting and drilling operations and especially when the system is heave compensated. To increase the service life of the cable after a known number of lifting cycles the cable is shifted to move the places of repeated bending. In hoist systems known from prior art this is done by a procedure known as the "slip & cut" procedure. This takes considerable time and is not without personal danger.

It is therefore an object of this invention to provide a hoist system by mechanism of which an increased level of redundancy is provided. It is another object of this invention to provide mechanism with which the time consuming and dangerous "slip & cut" procedure can be avoided altogether. An object of this invention is to provide a hoist system with relatively inexpensive winches decreasing the building and operating cost of the hoist system.

It is therefore advantageous for the hoisting mechanism to be provided with two winches, each end of the hoisting cable being wound onto a separate winch. By winding the two ends onto a separate winch, it is possible to achieve the same cable speed at a relatively low speed of revolution of the winches. By using two winches the cable can be shifted automatically a distance from one winch to the other winch replacing the "slip & cut" procedure. This takes considerably less time and can be performed completely automatic reducing the chance of personal injuries. It can even be performed during compensation operations.

Moreover, by adding the second winch, redundancy is provided in the system. Should one of the winches fail, then the hoist system is not unusable, but it is possible to continue working with a single winch.

It is advantageous for the winches to be driven by a plurality of relatively small motors. Because of the fact that twice as many sides of the winches can be used to attach the motor on these motors can be relatively small. For example, it is possible to equip the winches on both sides with electric motors that engage with a pinion in a toothed wheel of the winch. First, this has the advantage that such electric motors are commercially available. For the use of the hoist system it is therefore not necessary to develop a special, and therefore expensive, hoisting winch. Secondly, the relatively small motors have a low internal inertia, which mechanism, for example, that when the direction of rotation of the winch is reversed less energy and time are lost during the reversal.

In the case of a hoist system according to the prior art of the type mentioned in the preamble, finding the optimum compromise between speed and power is a known problem. The hoisting cable is guided in such a way over the cable blocks in the base structure and on the trolley that several cable parts extend between the base structure and the trolley. In this case the more wire parts are present between the base structure and the trolley; the greater the load that can be lifted with the hoist system if the hoisting winch remains unchanged. However, the more wire parts are present between the base structure and the trolley, the lower the speed at which the trolley can be moved relative to the base structure when the maximal speed of the winch stays the same.

In order to find a good compromise between speed and lifting power, it is generally decided to provide the hoist system with relatively heavy winches. The heavy winches ensure that the requirement of being able to move the trolley up and down rapidly can be met in every case. However, that also mechanism that a substantial part of the lifting power is not being utilized for a substantial part of the time. In other words, the device is actually provided with too heavy—and therefore too expensive—winches to be able to reach sufficient speed occasionally.

It is therefore a further object of the present invention to provide a hoist system of the type mentioned in the preamble. By mechanism of which, on the one hand, a relatively heavy load can be lifted and on the other hand, a relatively light load can be operated at a relatively high speed, while the hoisting mechanism can be of a relatively light and cheap design.

The object is achieved in the present invention by the fact that the hoisting cable is also guided over loose pulleys that can be moved between a first position, in which the loose pulleys are connected to the base structure, and a second position, in which the loose pulleys are connected to the trolley.

The effect of this measure is that the number of wire parts between the base structure and the trolley can be set as desired. When the loose pulleys are attached to the base structure, few wire parts will extend between the base structure and the trolley, and a relatively low weight can be lifted with a relatively high speed. When the loose pulleys are attached to the trolley, a relatively large number of wire parts will extend between the base structure and the trolley, and the trolley can be moved at a relatively low speed relative to the base structure with a relatively large load. Since the hoisting cable is guided over the pulleys and the pulleys can be attached as desired to the base structure or to the trolley, the hoisting cable does not have to be reeved again. That mechanism that the desired number of wire parts can be set in a relatively short time.

It is possible according to the invention for the loose pulleys to be attached symmetrically relative to the center of the base structure.

This ensures that the forces exerted upon the cables are also transmitted symmetrically to a base structure, which mechanism that no additional bending loads are exerted upon the base structure limiting the necessary weight of the base structure.

It is possible according to the invention for the loose pulleys to be accommodated in a housing, which at least on the bottom side is provided with locking elements for fixing the pulleys on the trolley. The loose pulleys are pulled automatically into their first position, in contact with the base structure, by tension in the hoisting cable. It is therefore sufficient to provide the bottom side of the pulleys with locking elements.

SUMMARY OF THE INVENTION

The invention is a hoisting device for a vessel. The vessel has base structure provided with fixed cable blocks with pulleys. The hoisting device has a trolley connected to a cable pulley block and a mechanism for gripping a load. The device also has a compensator a hoisting mechanism with a hoisting cable and a winch, wherein the hoisting cable is guided over the cable pulleys connected to the base structure and is adapted to move the trolley relative to the base structure with the aid of the winch. The hoisting device also includes a secondary compensator with fixed cable blocks and pulleys connected to the base; a cable pulley set connected to the compensator end; a connection cable connected to a stationary section and a movable cable block with pulleys; a hoist connected to the vessel; a connecting cable guided over pulleys; and movable cable block and is adapted to move the compensator second end with the aid of the secondary hoisting mechanism.

BRIEF DESCRIPTION OF THE DRAWINGS

The present invention will be described further with reference to the appended drawings, in which.

The present invention is detailed below with reference to the listed FIGS.

DETAILED DESCRIPTION OF THE PREFERRED EMBODIMENTS

Before explaining the present invention in detail, it is to be understood that the invention is not limited to the particular embodiments and that it can be practiced or carried out in various ways.

Figure 1:
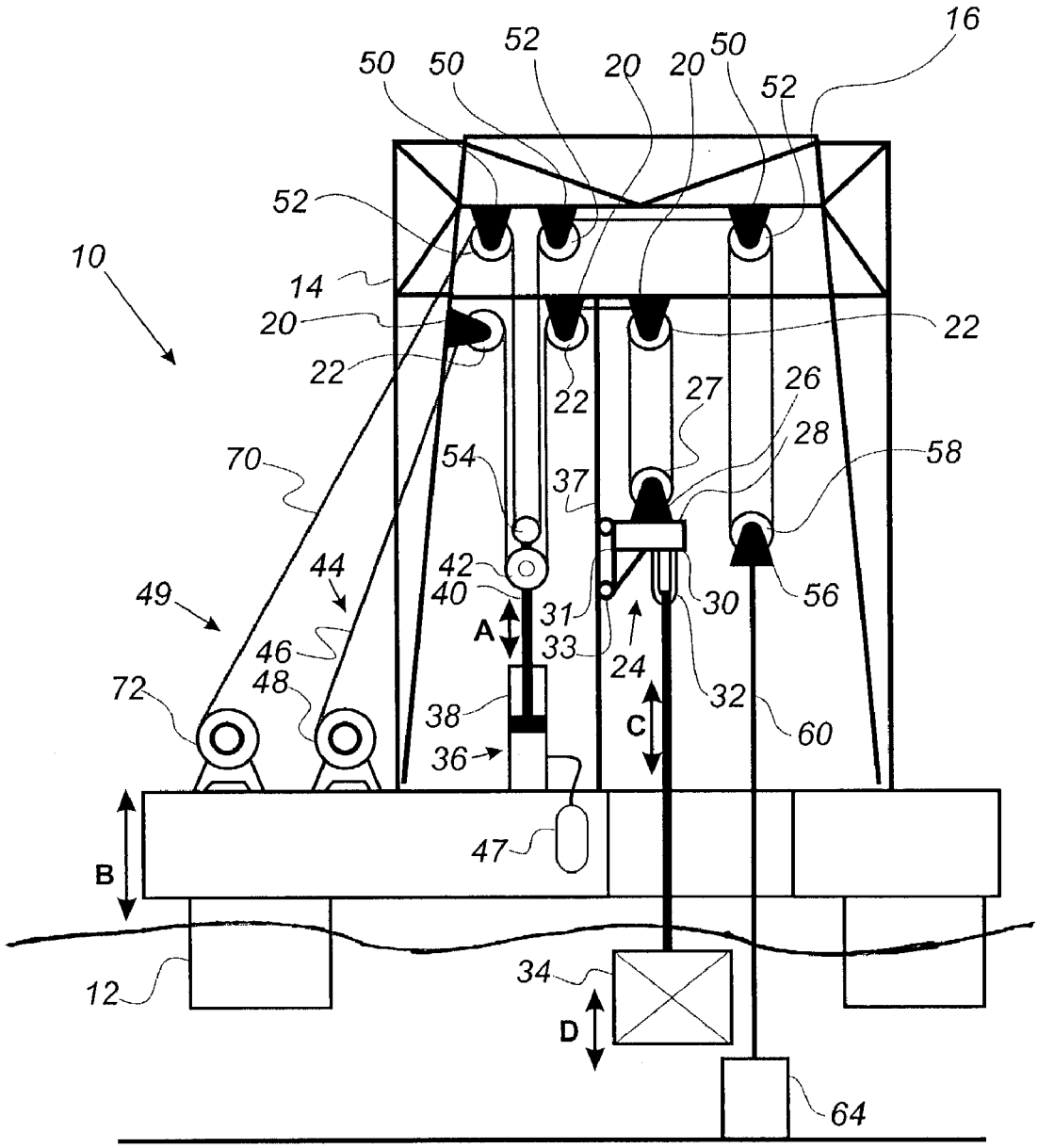
FIG. 1 shows a schematic view of the hoist system according to the present invention.

FIG. 1 shows a schematic view of the compensation system 1 according to the present invention. Visible is a hoisting device (10) for a vessel (12) which comprises a base structure (14) preferably in the form of a derrick having a top side (16) provided with fixed cable blocks (20) with first pulleys (22); a trolley (24) connected to a cable pulley block (26), which is movably fixed on the base structure (14) preferably by mechanism of wheels (33) connected to the trolley base (31) running on trolley rails (37), on a top side (28) connected to the cable pulley block (26) with a second pulley (27), and on a bottom side (30) to mechanism (32) for gripping a load (34); a compensator (36) having a first end (38) and a second end (40), which is at the second end (40) connected to pulleys (42).

The compensator second end (40) is movable with respect to the compensator first end (38) as indicated with arrow denoted by A. Visible also are hoisting mechanism (44), equipped with a hoisting cable (46) and a first winch (48). The hoisting cable (46) is guided over the cable pulleys (22), (27) and (42) of the base structure (14), the compensator (36) and the trolley (24) respectively, and is adapted to move the trolley (24) relative to the base structure (14) with the aid of the first winch (48). The hoisting cable (46) is guided over the cable pulleys (22), (27), (42) in such a way that force can be exerted upon the hoisting cable (46). The compensator can be a hydraulic cylinder as is shown in FIG. 1 or any other suitable device. To decrease the stiffness of the hydraulic cylinder which acts as a spring the hydraulic cylinder is connected to a separate pressure vessel (47) filled with a compressible gas.

A secondary compensator (49) is visible which comprises a multitude of fixed cable blocks (50) with pulleys (52) connected to the base structure (14); a second cable pulley set (54) connected to the compensator second end (40) and a connection cable (60) at a first end connected to a stationary section (64) such as a riser and at a second end connected to a movable cable block (56) with the cable pulleys (58). Part of the secondary compensator (49) is a secondary hoisting mechanism (72) connected to the vessel (12) and a second connecting cable (70) guided over the pulleys (52), (54), (58) of the vessel (12), the compensator (36) and the movable cable block (56) and is adapted to move the compensator second end (40) with the aid of the secondary hoisting mechanism (72). The second connecting cable (70) is guided over pulleys (52), (54), (58) in such a way that force can be exerted upon the compensator second end (40).

When the vessel is moving in the direction indicated with arrow B the trolley has to move downward in the direction indicated with arrow C in order to keep the load at a constant distance from a stationary reference (64) or to keep the tension in the hoisting cable constant. The stationary reference (64) can be a riser, a downhole section or the seabed. Moving trolley (24) in the direction indicated with arrow C is only possible when compensator second end (40) moves in the direction indicated with arrow A when first winch (48) is stationary.

The compensator in this embodiment acts as a spring with a very low stiffness. Since the "spring" does not have an indefinitely low stiffness a certain variation in the line tension is always necessary to retract or extend the compensation cylinder. Normally when a drilling bit is in contact with the ground the drilling bit takes up the variation in line tension. This is undesired because it causes excessive wear of the drilling bit or decreased drilling performance.

In the present invention the tension variation is taken up by a connection cable (60) that is connected to the stationary reference (64). The effect of this additional cable is that the drilling bit or any other load (34) connected to the hoisting cable (46) does not experience a variation in force regardless of the movement of the vessel (12).

It is desirable that the load that acts on the drilling bit or other load can be set. With the system as described in the invention this is accomplished by the secondary hoisting mechanism (72).

FIG. 1 also shows that in one embodiment the trolley (24) comprises a base (31) supported by a plurality of wheels (33) for slidingly engaging the trolley rails (37).

Figure 2:
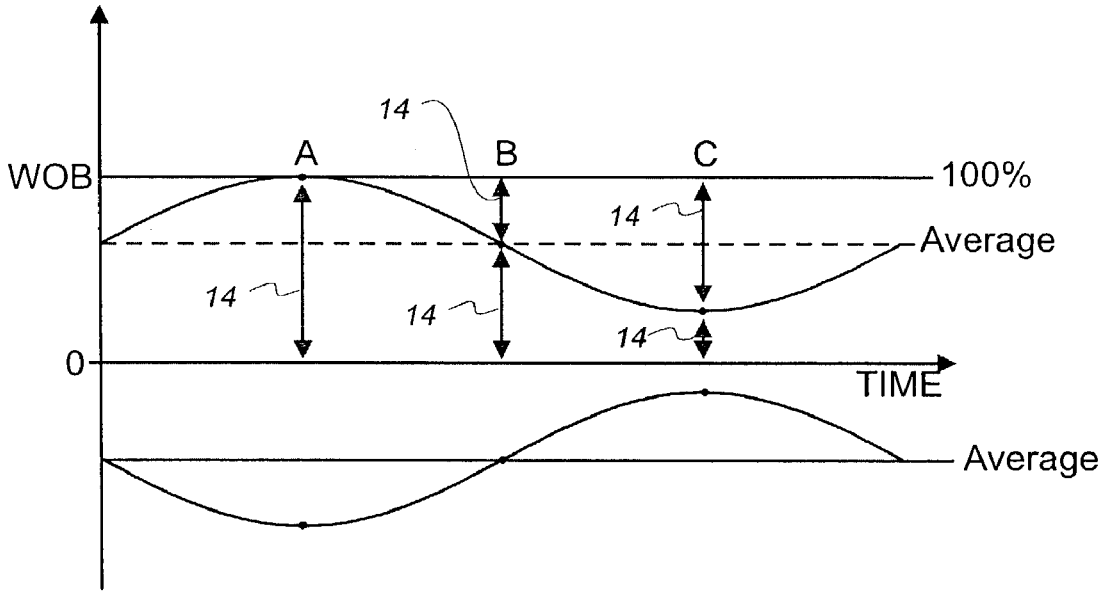
FIG. 2 shows a graph indicating the different force components that are present in the system.

Going to FIG. 2, the load variation of the compensator (36) is shown as a result of the movement of the vessel (12). Also shown is the compensation load of the secondary compensator (49). The resulting tension in the hoisting cable (46) will remain at a constant level independent of any movement of the vessel (12).

In the shown graph the ratio between the compensator (36) tension and the secondary compensator (49) tension is approximately 0.1. This mechanism that when a load (34) of 1000 mt must be compensated, on average 1000 mt is compensated by the compensator (36) and on average 100 mt additional force is compensated by the secondary compensator (49). By paying out or paying in the second compensation cable (70) this ratio can be set within limits as desired when the hoist system (10) is in use. Large ratios can be achieved by presetting the compensator (36) tension in advance to higher or lower compensation tensions. A ratio of 0.5 can be achieved by setting the compensator (36) to 1500 mt tension comprising of 1000 mt load tension and 500 mt secondary compensator (49) tension.

It is advantageous that the secondary compensator (49) is kept as small as possible preferably smaller compared to the compensator (36). A small secondary compensator (49) has the disadvantage that only a small tension variation can be compensated. Also the secondary hoisting mechanism (72) can be used to hoist or lower the load (34) over small distances while the motions of the vessel (12) are being compensated at the same time. The maximal distance of lowering or hoisting the load in this configuration is over the maximal stroke of the compensator (36). When both first winch (48) and secondary hoisting mechanism (72) are being used the load can be lowered over the full distance the trolley can travel while the motions of the vessel (12) are being compensated at the same time.

Figure 3:
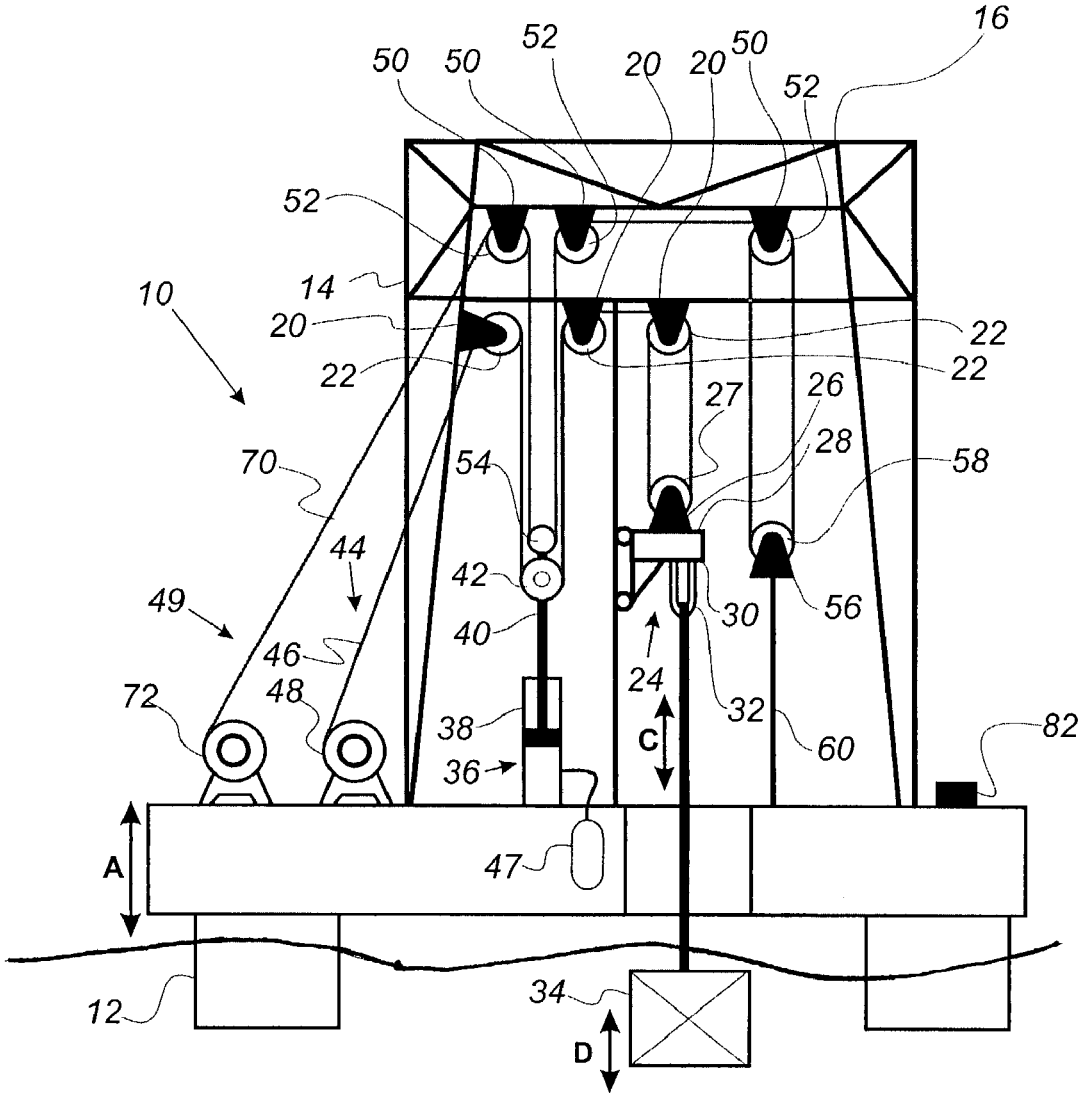
FIG. 3 shows a second embodiment of the hoist system according to the present invention.

FIG. 3 shows a second embodiment of the invention. As can be seen, the connection cable (60) to the fixed reference (64) is no longer present. Instead a motion and load sensing device (82) is used to measure the tension in the hoisting cable (46) and the movement of the vessel (12).

The secondary hoisting mechanism (72) is controlled in such a way that it counteracts any movements of the vessel (12) and any unwanted tension variations of the compensator (36). Since the secondary compensator (49) is smaller than the compensator (36) the power that is needed to compensate for tension variations is also smaller. When this ratio is 0.9 the power that is needed for the second compensation system (49) is approximately 10% of the total compensation power. The remaining 90% is provided by the compensator (36). This compensator system is often a passive system which comprises an energy storage to reduce the overall power demand of the system to almost zero. The advantage of this embodiment is that the stationary reference is no longer needed meaning that loads can be lowered or lifted from locations where a connection cable (60) cannot be installed.

Figure 4:
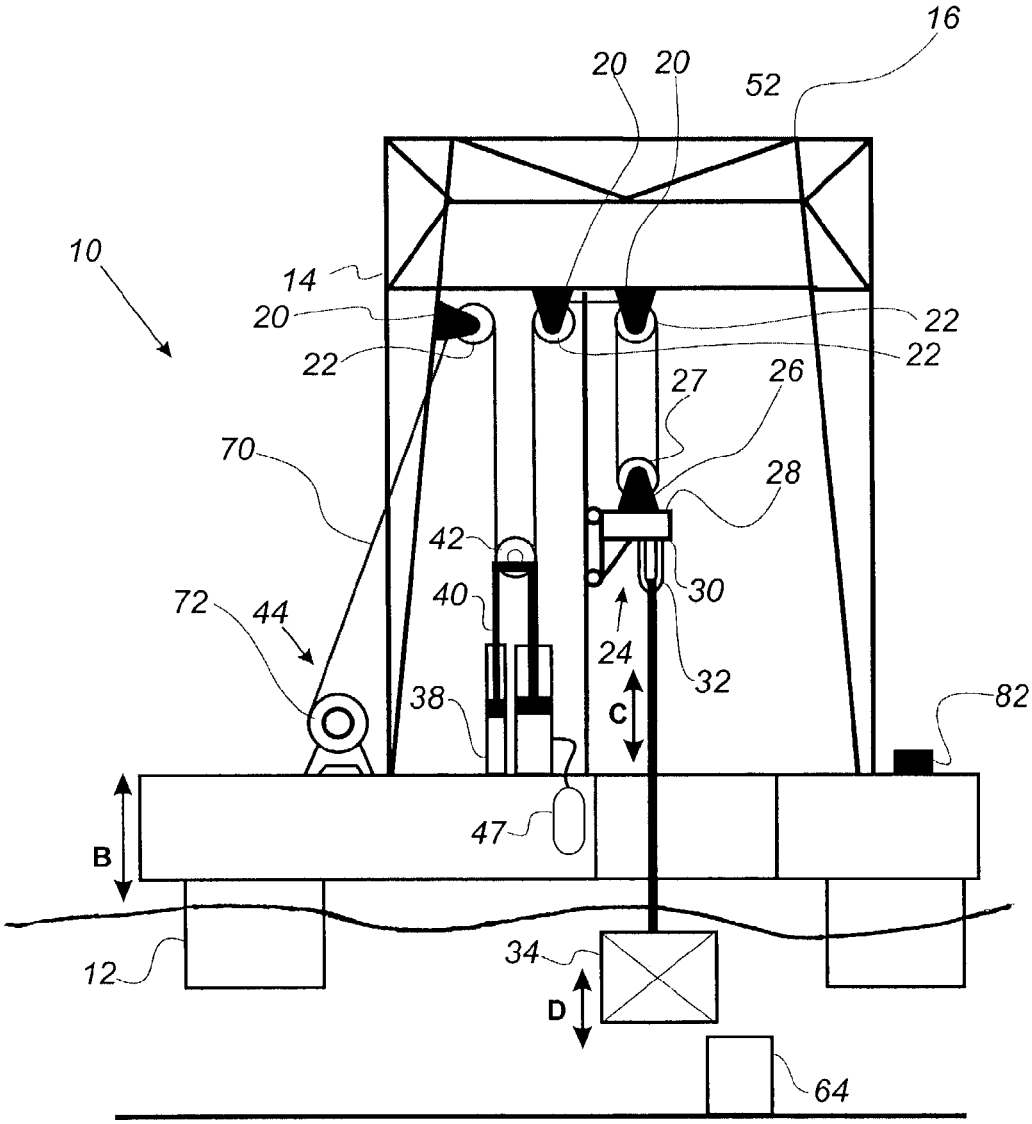
FIG. 4 shows a third embodiment of the hoist system according to the present invention.

FIG. 4 shows a third embodiment of the hoisting device (10). This embodiment does not use a secondary hoisting mechanism (72) to compensate for the movement of the vessel or tension variations of the compensator (36) but instead uses a third compensator (80) having a first end (86) and a second end (88), which is at the second end (88) connected to pulleys (42). The compensator second end (88) is movable with respect to the first end (86) and compensator (80) is mounted on the vessel (12). A motion and load sensing device (82) is visible to detect the tension in hoisting cable (46) and/or the movement of the vessel (12) which is connected to a controller (90) to control compensator (36) by mechanism of third compensator (80).

Figure 5:
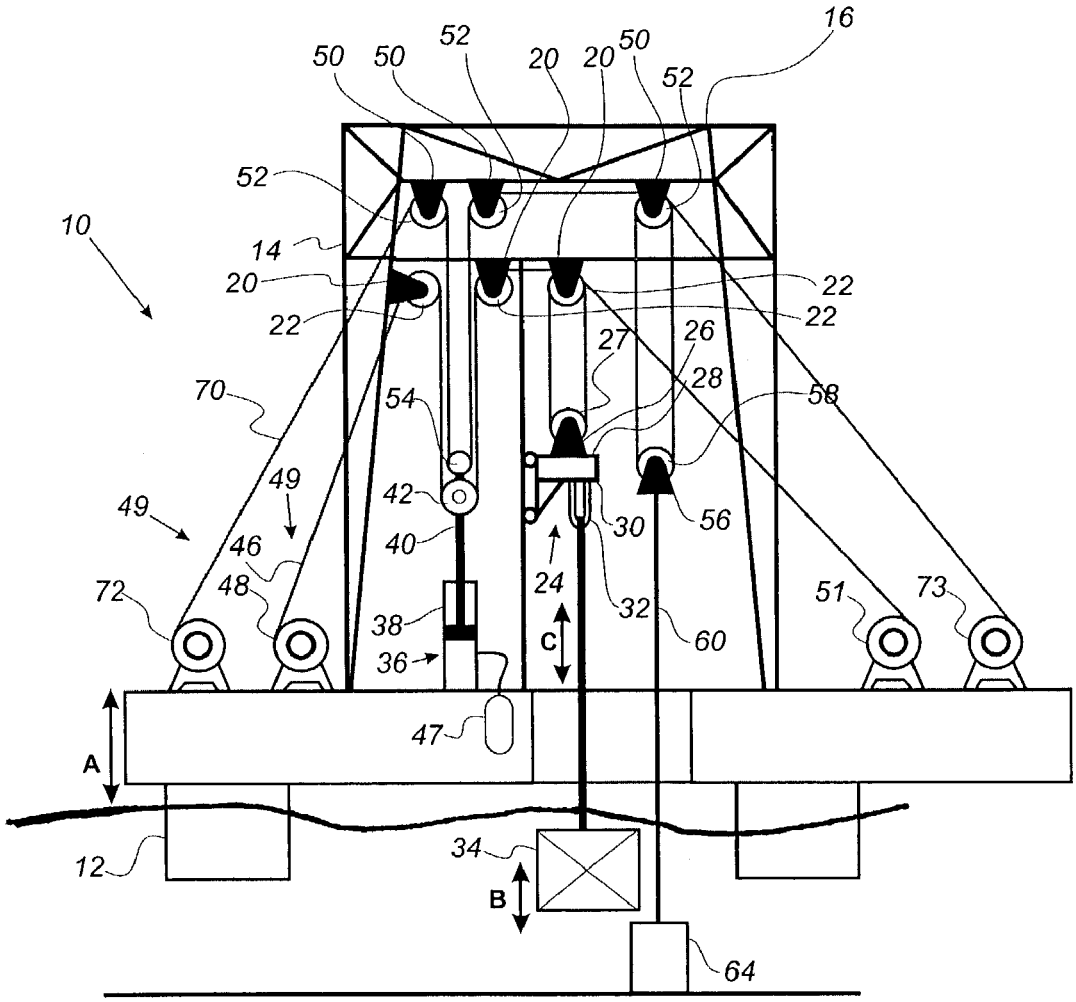
FIG. 5 shows a embodiment of the invention with a dual winch configuration.

FIG. 5 show's the hoisting device (10) in which are at least two winches, (48, 51) each end of the hoisting cable (46) being wound into a separate winch (48, 51). The winches (48, 51) are driven by a plurality of motors with low inertia. Also in this embodiment each end of the connecting cable (70) is wound onto a separate winch (72, 73). At least one of the winches (72, 73) is provided with a slip brake, for paying out the connecting cable (70) when a maximum pulling force in the connecting cable (70) is exceeded.

Figure 6:
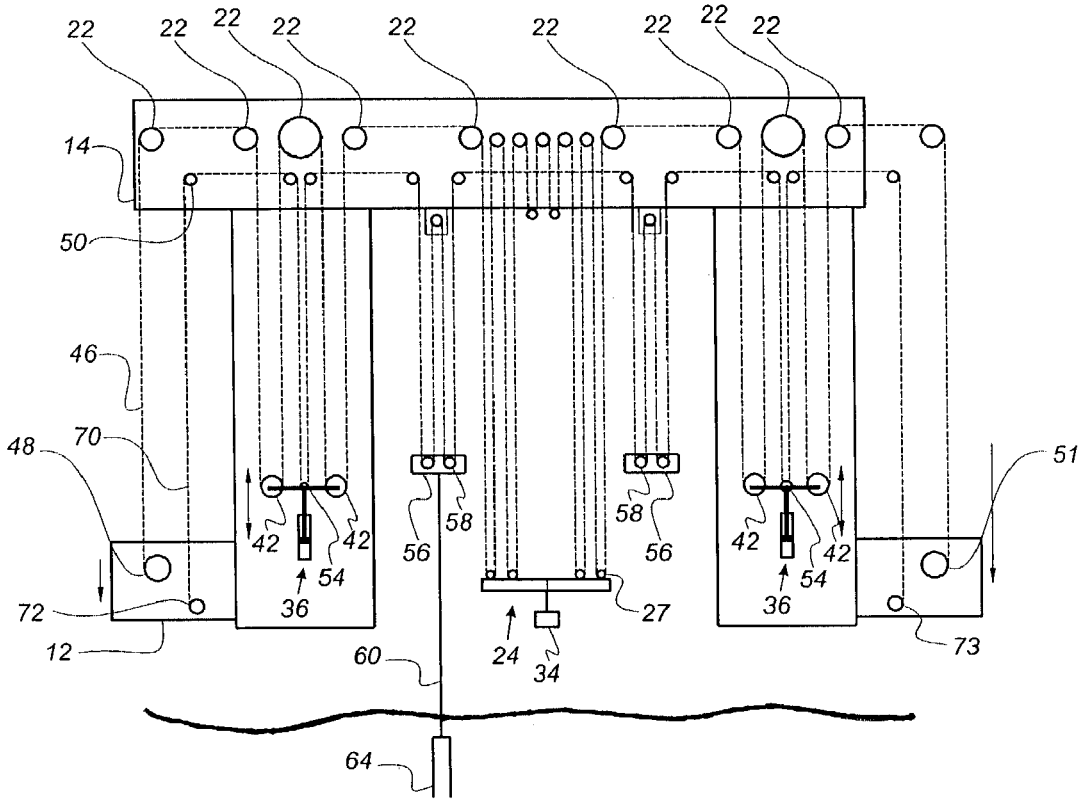
FIG. 6 shows a schematic of the present invention with splittable block in heavy load lifting configuration.

FIG. 6 shows the hoisting cable (46) can be also guided over a splittable block (92) in which the splittable block (92) further comprises at least one loose pulley (94), which is movable between a first position, in which the loose pulley (94) is connected to the base structure (14), and a second position, in which the loose pulley (94) is connected to the trolley (24).

The second connecting cable (70) is also guided over a splittable block (96) with loose pulleys (98), which are movable between a first position, in which the loose pulleys (98) are connected to the base structure (14), and a second position, in which the loose pulleys (98) are connected to the stationary section, such as the top side of the riser (64). Shown is the configuration for heavy load lifting. In this configuration all the loose pulleys (98) are connected to the movable trolley (24).

Figure 7:
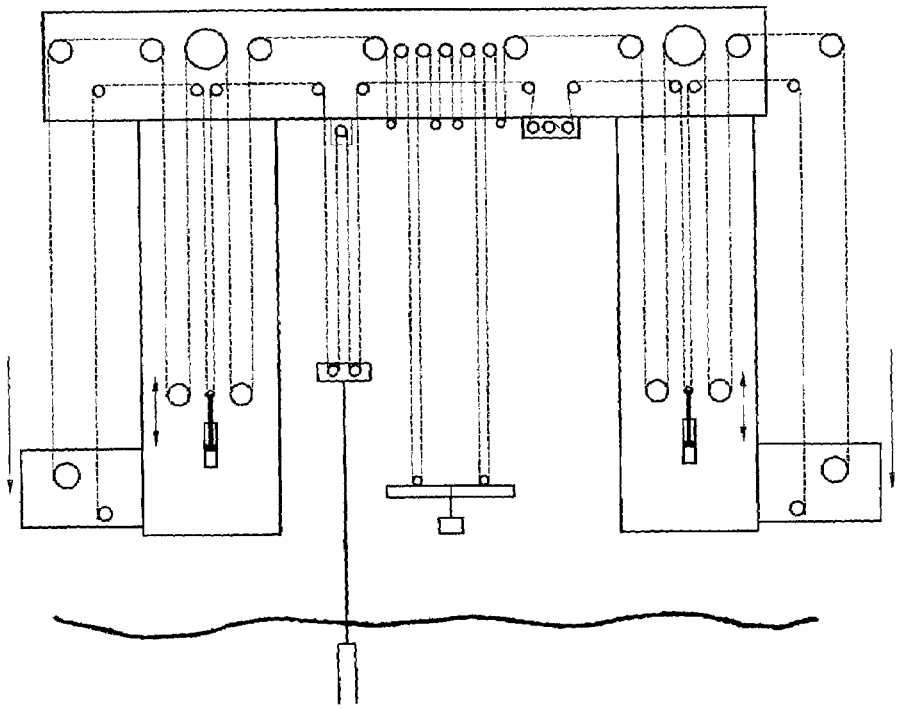
FIG. 7 shows a schematic of the present invention with splittable block in light load lifting configuration.

FIG. 7 shows the hoisting cable (46) is guided over the first splittable block (92) in the light load configuration. In the light load configuration only a part of the total number of loose pulleys (94) are connected to the movable trolley. The other part is connected to the base structure (14).

Figure 8:
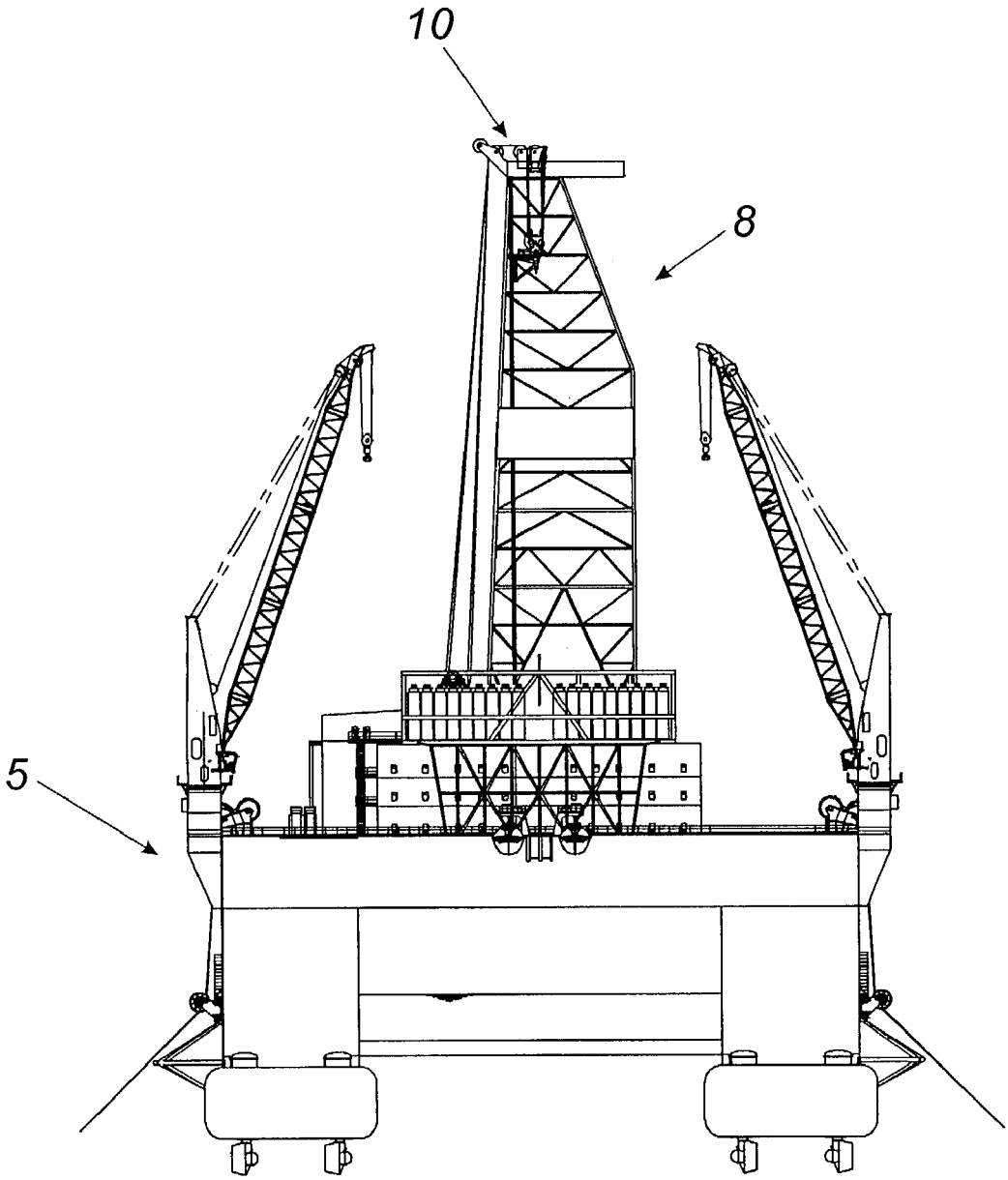
FIG. 8 shows a detailed drawing of the invention on a derrick.

FIG. 8 shows a side view of one of the loose pulleys (94) (98). The lock (114) is shown in two positions. The position of the lock is determined with the aid of a cylinder (124). When the cylinder is not actuated, the lock falls behind the pin (121) during two-blocks pulling. The pulley (94) (98) is thus connected to the trolley (24). When the trolley (24) during use is moved relative to the supporting base (14), the trolley (24) takes that loose pulley (94, 98) along with it downwards. If, on the other hand, the cylinder is actuated, the hook cannot grip behind the pin (121), and that mechanism that the trolley (24) cannot take the pulley (94) (98) along with it, so that the pulley (94) (98) remains behind at the supporting base (14).

In one embodiment the hoisting device (10) is equipped with at least two winches, (48, 51) each end of the hoisting cable (46) being wound into a separate winch (48, 51). These winches (48, 51) are driven preferably by a plurality of motors with low inertia. Each end of the second connecting cable (70) is wound onto a separate winch (72, 73).

As shown in FIG. 6 the cable pulley block (26) comprises a first splittable block (92) in which the splittable block (92) further comprises at least one first loose pulley (94), which is movable between a first position, in which the first loose pulley (94) is connected to the base structure (14), and a second position, in which the first loose pulley (94) is connected to the trolley (24). The first loose pulleys (94) are accommodated in a first housing (95), which at least on the bottom side is provided with first locking elements (97) for fixing the first loose pulleys (94) on the trolley (24). The movable cable block (56) comprises a second splittable block (57) further comprising loose pulleys (98), which are movable between a first position, in which the loose pulleys are connected to the base structure (14), and a second position, in which the second loose pulleys (98) are connected to the stationary section, such as the top side of the riser (64). The second pulleys (98) are accommodated in a second housing (105), which at least on the bottom side is provided with second locking elements (107) for fixing the second loose pulleys (98) on the stationary section, such as the top side of the riser (64). Between one and eight first splittable blocks (92) can be used in the invention. Between one and eight second splittable blocks (94) can be used. Between 2 loose pulleys (98) and 16 loose pulleys (98) can be used in each splittable block.

Between 2 fixed first pulleys (104) and 8 fixed first pulleys (104) can be used in each second splittable block.

Preferably the same number of second fixed (104) and second loose pulleys (98) are used as the number of first fixed pulleys (102) and first loose pulleys (94).

At least one of the winches (72, 73) is provided with a slip brake, for paying out the second connecting cable (70) when a maximum pulling force in the second connecting cable (70) is exceeded.

The base structure (14) can be a derrick with a height between 30 feet and 180 feet, a width between 3 feet and 60 feet and a length between 3 feet and 60 feet.

The base structure (14) can also be a mast.

The gripper (32) can be adapted to support between 10 metric tons and 1000 metric tons and the gripper (32) can be in the form of a hook.

Hoisting cable (46) has a diameter ranging between 0.5 inches and 3 inches and is adapted to support a load (34) of between 1 metric tons and 100 metric tons.

A main controller (100) for monitoring and driving the hoist cable (46), the first winch (48), the secondary hoisting mechanism (72), the splittable blocks (92), (96), and the trolley (24) is also present.

While this invention has been described with emphasis on the preferred embodiments, it should be understood that within the scope of the appended claims, the invention might be practiced other than as specifically described herein.

What is claimed is:

1. A hoisting device (10) for a vessel (12) comprising:

a. a base structure (14) connected to the vessel having a top side (16) provided with fixed cable blocks (20) with pulleys (22);

b. a trolley (24) connected to a cable pulley block (26), which is movably fixed on the base structure (14), on a top side (28) connected to the cable pulley block (26) with pulley (27), and on a bottom side (30) to mechanism (32) for gripping a load (34);

c. a compensator (36) having a first end (38) and a second end (40), which is at the second end (40) connected to pulleys (42) wherein the compensator second end (40) is movable with respect to the first end (38);

d. a hoisting mechanism (44), at least equipped with a hoisting cable (46) and a winch (48), wherein the hoisting cable (46) is guided over the cable pulleys (22), (27) and (42) connected to the base structure (14), the compensator (36) and the trolley (24), and is adapted to move the trolley (24) relative to the base structure (14) with the aid of the winch (48); and wherein the hoisting cable (46) is guided over the cable pulleys (22), (27), (42) so that force can be exerted upon the hoisting cable (46); and e. a secondary compensator (49) comprising:

i. a second fixed cable blocks (50) with pulleys (52) connected to the base structure (14);

ii. a second cable pulley set (54) connected to the compensator second end (40);

iii. a secondary hoisting mechanism (72) connected to the vessel (12);

iv. a second connecting cable (70) guided over the pulleys (52), (54), (58) of the vessel (12), the compensator (36) and the movable cable block (56) and is adapted to move the compensator second end (40) with the aid of the secondary hoisting mechanism (72); and wherein the second connecting cable (70) is guided over pulleys (52), (54), (58) so that force can be exerted upon the compensator second end (40); and v. a sensor to detect the tension in hoisting cable (46) or the movement of the vessel (12) connected to a controller to control secondary hoisting mechanism (72).

2. The hoist device of claim 1 wherein the base structure (14) is a derrick.

3. The hoist device of claim 1, wherein the derrick (14) has a height between 30 feet and 180 feet.

4. The hoist device of claim 1, wherein the derrick (14) has a width between 3 feet and 60 feet and a length between 3 feet and 60 feet.

5. The hoist device of claim 1, further comprising at least two winches, (48, 51) at each end of the hoisting cable (46) wound into a separate winch (48, 51).

6. The hoist device of claim 1, wherein at one of the winches (72, 73) is provided with a slip brake for paying out the second connecting cable (70) when a maximum pulling force in the second connecting cable (70) is exceeded.

7. The hoist device of claim 1, wherein between one and eight first splittable blocks (92) are used.

8. The hoist device of claim 1, wherein between one and eight second splittable blocks (94) are used.

9. The hoist device of claim 1, wherein the trolley (24) comprises a base (31) supported by a plurality of wheels (33) for slidingly engaging the trolley rails (37).

10. The hoist device of claim 1, wherein the gripper (32) is adapted to support between 10 metric tons and 1000 metric tons.

11. The hoist device of claim 10, wherein the gripper (32) is a hook.

12. The hoist device of claim 1, wherein the hoist cable (46) has a diameter ranging between 0.5 inches and 3 inches and is adapted to support a load (34) ranging between 1 metric ton and 100 metric tons.

13. The hoist device of claim 1, further comprising a main controller (100) for monitoring and driving the hoist cable (46), the first winch (48), the secondary hoisting mechanism (72), the splittable blocks (92 and 96), and the trolley (24).

14. A method to compensate for vessel motions without the use of a stationary reference comprising the steps of:

a. running the hoisting cable (46) through the first splittable block (92) connected to the trolley topside (28) and the supporting base (14), over the first pulleys (22), over the second pulley (27), over compensator pulleys (42) to first winch (48) forming a hoisting device (10);

b. running the second connection cable (70) through the second splittable cable block (57) through third fixed cable blocks (50), over the second cable pulley set (54) to secondary hoisting mechanism (72) forming a secondary compensator (49);

c. locking the second splittable cable block (57) to the vessel (12) or the base structure (14);

d. activating secondary hoisting mechanism (72);

e. activating first winch (48);

f. moving compensator (36) to a position where the distance between compensator second end (40) and compensator first end (38) is minimal;

g. moving the trolley (24) to an upper position by paying in hoisting wire (46);

h. moving the second splittable block to an upper position by paying in connection cable (60);

i. setting the correct number of first loose pulleys (94);

j. setting the same number of second loose pulleys (96);

k. lowering the trolley (24) by paying out the hoisting cable (46);

l. lowering the second splittable block (96) by paying out connection cable (60);

m. attaching the load (34) to the gripping mechanism (32);

n. attaching the second splittable block (96) to the vessel (12);

o. activating the motion sensor and detect the motions of the vessel;

p. activating the secondary compensator (49) compensator (36) and compensate for vessel motions using a controller and the motion sensor;

q. placing the load (34) by paying out hoisting cable (46);

r. stopping first winch (48); and s. stopping secondary hoisting mechanism (72).

15. A method for lowering a load and placing the loads on a stationary reference comprising:

a. running the hoisting cable (46) through the first splittable block (92) connected to the trolley topside (28) and the supporting base (14), over the first pulleys (22), over the second pulley (27), over compensator pulleys (42) to first winch (48) forming a hoisting device (10);

b. running the second connection cable (70) through the second splittable cable block (57) through third fixed cable blocks (50), over the second cable pulley set (54) to secondary hoisting mechanism (72) forming a secondary compensator (49);

c. locking the second spliltable cable block (57) to the vessel (12) or the base structure (14);
d. activating secondary hoisting mechanism (72);
e. activating first winch (48);
f. moving compensator (36) to a position where the distance between compensator second end (40) and compensator first end (38) is minimal;
g. moving the trolley (24) to an upper position by paying in hoisting wire (46);
h. moving the second splittable block to an upper position by paying in connection cable (60);
i. setting the correct number of first loose pulleys (94);
j. setting the same number of second loose pulleys (96);
k. lowering the trolley (24) by paying out the hoisting cable (46);
l. lowering the second splittable block (96) by paying out connection cable (60);
m. attaching the load (34) to the gripping mechanism (32);
n. attaching the second splittable block (96) to the vessel (12);
o. activating the motion sensor and detect the motions of the vessel;
p. activating the secondary compensator (49) compensator (36) and compensate for vessel motions using a controller and the motion sensor;
q. placing the load (34) by paying out hoisting cable (46);
r. stopping first winch (48); and
s. stopping secondary hoisting mechanism (72).

* * * * *